US005081898A

United States Patent [19]

Fujimori

[11] Patent Number: 5,081,898

[45] Date of Patent: Jan. 21, 1992

[54] APPARATUS FOR GENERATING MUSICAL SOUND CONTROL PARAMETERS

[75] Inventor: Junichi Fujimori, Hamamatsu, Japan

[73] Assignee: Yamaha Corporation, Hamamatsu, Japan

[21] Appl. No.: 582,789

[22] Filed: Sep. 12, 1990

Related U.S. Application Data

[63] Continuation of Ser. No. 295,466, Jan. 10, 1989, abandoned.

[30] Foreign Application Priority Data

Jan. 11, 1988 [JP] Japan ..... 63-4363

[51] Int. Cl.[5] ..... G10H 7/00

[52] U.S. Cl. ..... 84/622; 84/602; 84/615; 84/626; 84/644

[58] Field of Search ..... 84/602, 615, 622, 626, 84/627-633, 644

[56] References Cited

U.S. PATENT DOCUMENTS

| | | | |
|---|---|---|---|
| 4,287,804 | 9/1981 | Hirose | 84/1.19 |
| 4,291,604 | 9/1981 | Scott et al. | 84/1.19 |
| 4,391,176 | 7/1983 | Niinomi et al. | 84/1.19 X |
| 4,429,606 | 2/1984 | Aoki | 84/1.17 |
| 4,472,993 | 9/1984 | Futamase | 84/1.25 X |
| 4,475,429 | 10/1984 | Suzuki | 84/1.19 |
| 4,483,231 | 11/1984 | Hirano | 84/1.19 |
| 4,497,235 | 2/1985 | Momoshima et al. | 84/1.19 |
| 4,586,417 | 5/1986 | Kato et al. | 84/1.19 X |
| 4,704,682 | 11/1987 | Clynes | 84/622 X |
| 4,706,537 | 11/1987 | Oguri | 84/622 X |
| 4,763,257 | 8/1988 | Clynes | 84/626 X |
| 4,862,783 | 9/1989 | Suzuki | 84/622 |

*Primary Examiner*—A. T. Grimley
*Assistant Examiner*—Matthew S. Smith
*Attorney, Agent, or Firm*—Spensley Horn Jubas & Lubitz

[57] ABSTRACT

The present invention provides an apparatus for generating musical sound control parameters. The musical sound control parameters are supplied to a musical sound generating apparatus for using them to generate musical sound by the musical sound generating apparatus. The apparatus is essentially composed of (a) timbre selecting operators; (b) timbre parameter generators for supplying timbre parameters corresponding to timbre selected by the timbre selecting operators to said music sound generating apparatus (c) effect control operators; and (d) effect control parameter generators for supplying plural effect control parameters varying in response to the timber selected by said timbre selecting operators and also varying in response to the operating situation of the effect control operators.

15 Claims, 11 Drawing Sheets

OPERATION PANEL

APPARATUS FOR GENERATING MUSICAL SOUND CONTROL PARAMETERS

This is a continuation of copending application Ser. No. 07/295,466 filed on Jan. 10, 1989 now abandoned.

BACKGROUND OF THE INVENTION

Conventionally, as shown in the disclosed Utility Model Invention 58-18297 (1983), this kind of apparatus has employed effect control operators operating on an effect control parameter generating means in order to supply plural effect control parameters to a musical sound generating apparatus. In these conventional devices, the number and kind of musical sound control parameters generated in response to the operation of one operator were fixed, and likewise, the characteristics of the musical sound control parameters generated were also fixed.

However, with such devices, the fixed range of musical sound control parameters generated were not always optimal for each timbre employed. Accordingly, the musical sound generated by such devices was not always optimal, and thereby, restrictions in the range and quality of producible music resulted. The present invention was devised in order to circumvent the above detailed shortcomings, the outcome being a device capable of delivering musical sound control parameters individualized and optimized for each kind of sound, for example, for each timbre. Thereby, rich and varied sound production under a variety of operating conditions is made available.

SUMMARY OF THE INVENTION

The present invention pertains to an apparatus for generating musical sound control parameters to be supplied to a musical sound generating apparatus for the formation and generation of musical sound, and more particularly, to an apparatus capable of supplying a wide variety of musical sound control parameters under a variety of operating conditions, employing a relatively small number of effect control operators. Furthermore, the described invention pertains to a device in which the generated sound control parameters are formed in a manner so as to be individualized and optimized for different operating conditions, for example, for each of the various timbres employed.

The described invention is comprised of the following features: an apparatus for generating musical sound control parameters to be supplied to a musical sound generating apparatus; timbre selecting operators; timbre parameter generating means for generation of timbre parameters as directed by the timbre selection operators; effect control operators; effect control parameter generating means for supplying plural effect control parameters as directed by the operating situation of the effect control operators, the supplied effect control parameters varying in response to the timbre selected by the timbre selecting operators.

The described invention can be constructed so as to provide for generation of a unique effect control parameter for each timbre chosen by the timbre selecting operator, and furthermore, so as to provide of generation of an effect control parameter varying in response to the operating situation of the effect control operators the varying response being unique for each timbre selected by the above mentioned timbre selecting operator.

Similarly, the described invention can be constructed so as to provide for effect control parameter kind selecting and setting means in which the effect control parameter generating means is capable of generating plural kinds of effect control parameters, varying in response to the operating situation of the effect control parameter kind selecting and setting means. With a device so constructed, the musician can freely set the kinds of plural effects to be given the musical sound and thus create the effect best suited to the chosen timbre of the musical sound. Likewise, the described invention can be constructed so as to provide for effect control parameter characteristics selecting and setting means in which the above mentioned effect control parameter generating means is capable of generating plural effect control parameters, the plural effect control parameters being of varying change characteristics, varying in response to the operating situation of the effect control parameter characteristics selecting and setting means. With a device so constructed, the musician can freely set the degree of plural effects to be given the musical sound and thus create the effect best suited to the chosen timbre of the musical sound.

DETAILED DESCRIPTION OF THE PREFERRED EMBODIMENT OF THE PRESENT INVENTION

Figure 1:
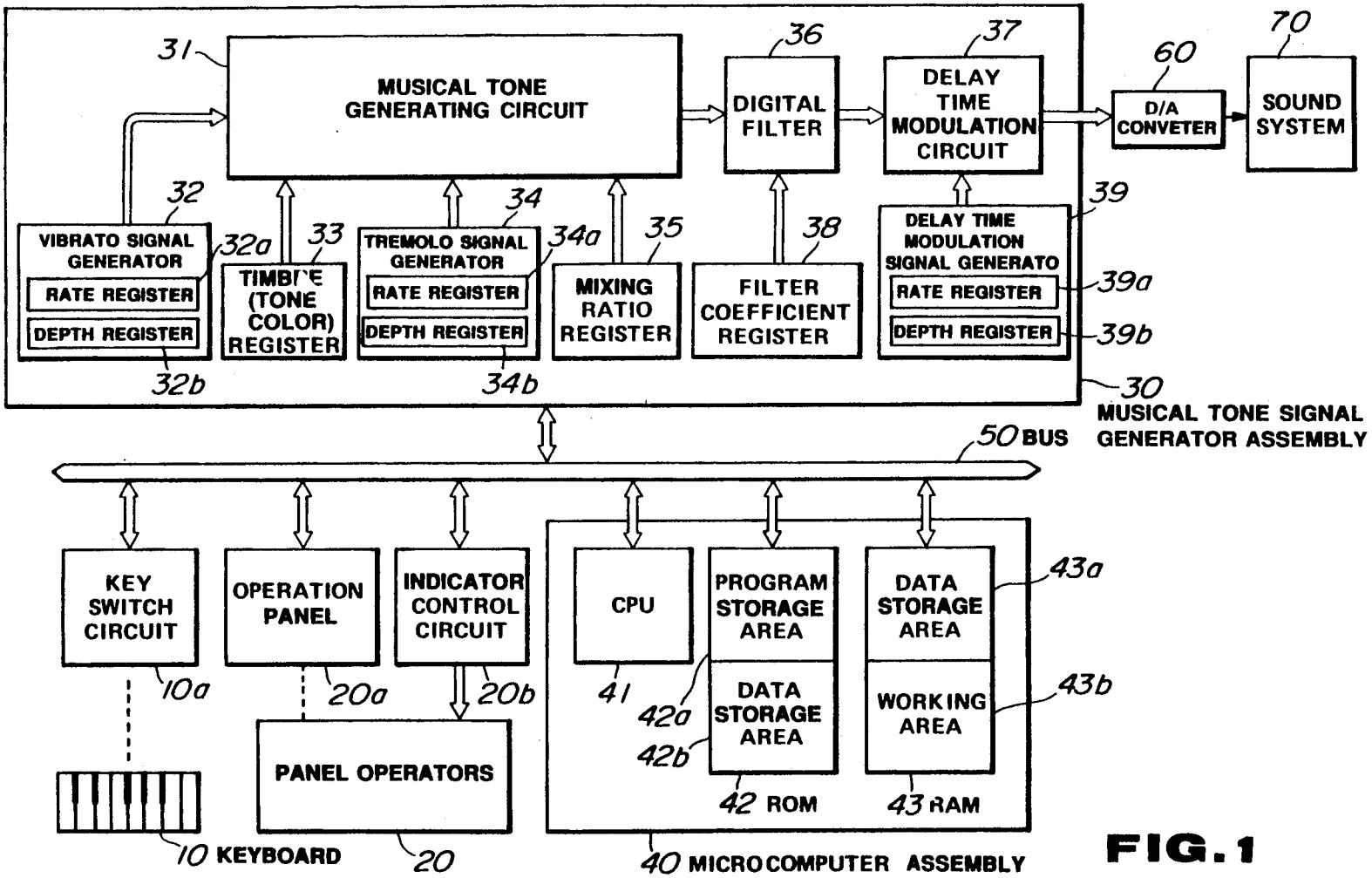
FIG. 1 shows a rough block diagram of an electronic music instrument having the apparatus for generating musical sound control parameters related to the referred embodiment of this invention.

A preferred embodiment of this invention will be described hereafter with reference to the drawings. FIG. 1 shows block diagram of an electronic musical instrument equipped with an apparatus for generating musical sound control parameters related to this invention. This electronic musical instrument comprises a keyboard 10, a group of panel operators 20, a musical sound signal generator assembly 30, and a microcomputer assembly 40.

Figure 2:
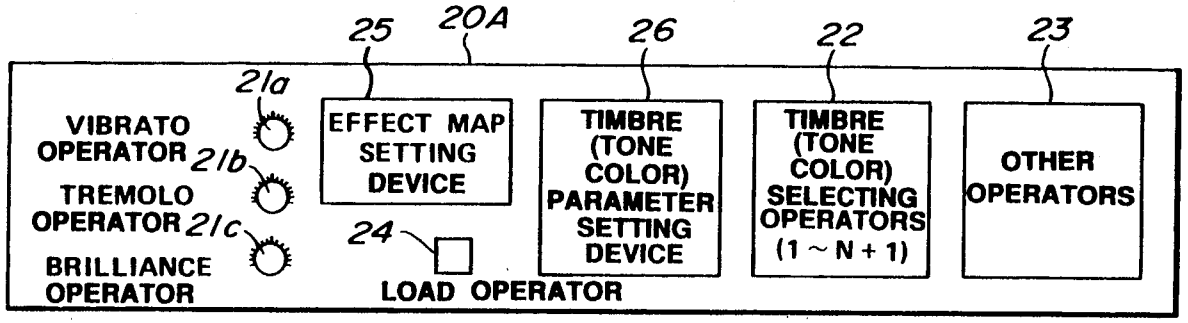
FIG. 2 is a rough external view showing the detail of the group of panel operators shown in FIG. 1.

The keyboard 10 comprises plural keys for designating the pitch of the musical sound to be generated. Pressing of keys is detected by plural switches corresponding to each key, which are located in a key switch circuit 10*a*. The key switch circuit 10*a* is connected to bus 50, and a pressed key detection signal detected by said key switch is supplied to a microcomputer assembly 40 through bus 50. The group of panel operators 20 is mounted on an operation panel 20A as shown in FIG. 2 and comprises a vibrato operator 21*a* for setting the degree of vibrato effect to be given to musical sound generated, a tremolo operator 21*b*, a brilliance operator 21*c*, a group of N+1 timbre selecting operators 22 with built-in lamps for selecting the timbres of musical sound generated, another group of operators 23 for setting volume and control parameters, and a load operator 24 for controlling the transfer of musical sound control data. In this case, the vibrato operator 21*a*, tremolo operator 21*b*, and brilliance operator 21*c* are characteristic in that they control the kinds and the number of effects which vary by the timbres 1 to N+1 selected by the group of timbre selecting operators 22. A example of the effects of control respectively by operators 21*a*, 21*b* and 21*c* is indicated in Table 1. Timbres 1 to N are the predetermined timbres of flute, violin, piano and so forth, and the timbre N+1 is the timbre arbitrarily set by the player.

Table

Figure 3:
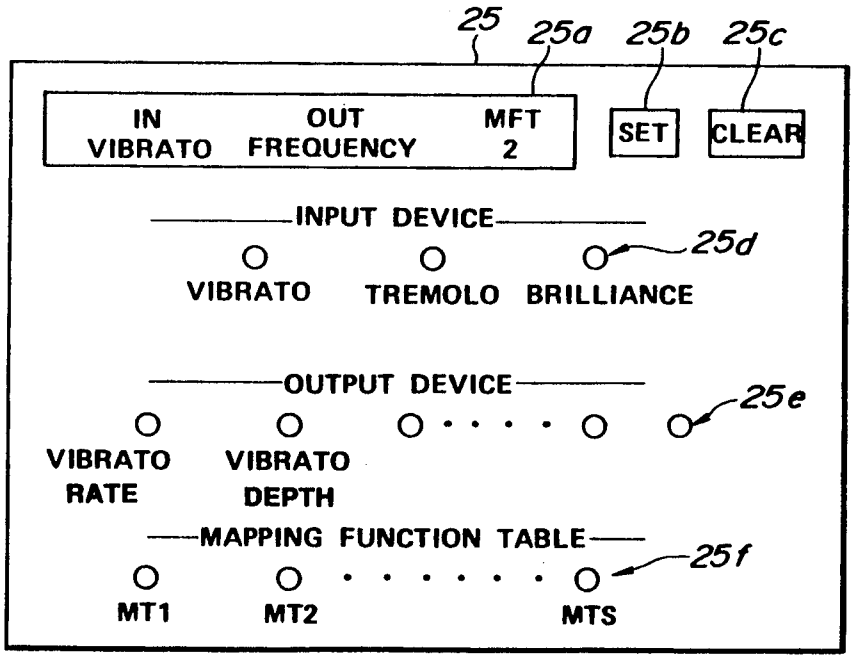
FIG. 3 is a detailed external view of the effect map setting device shown in FIG. 2.
Figure 4:
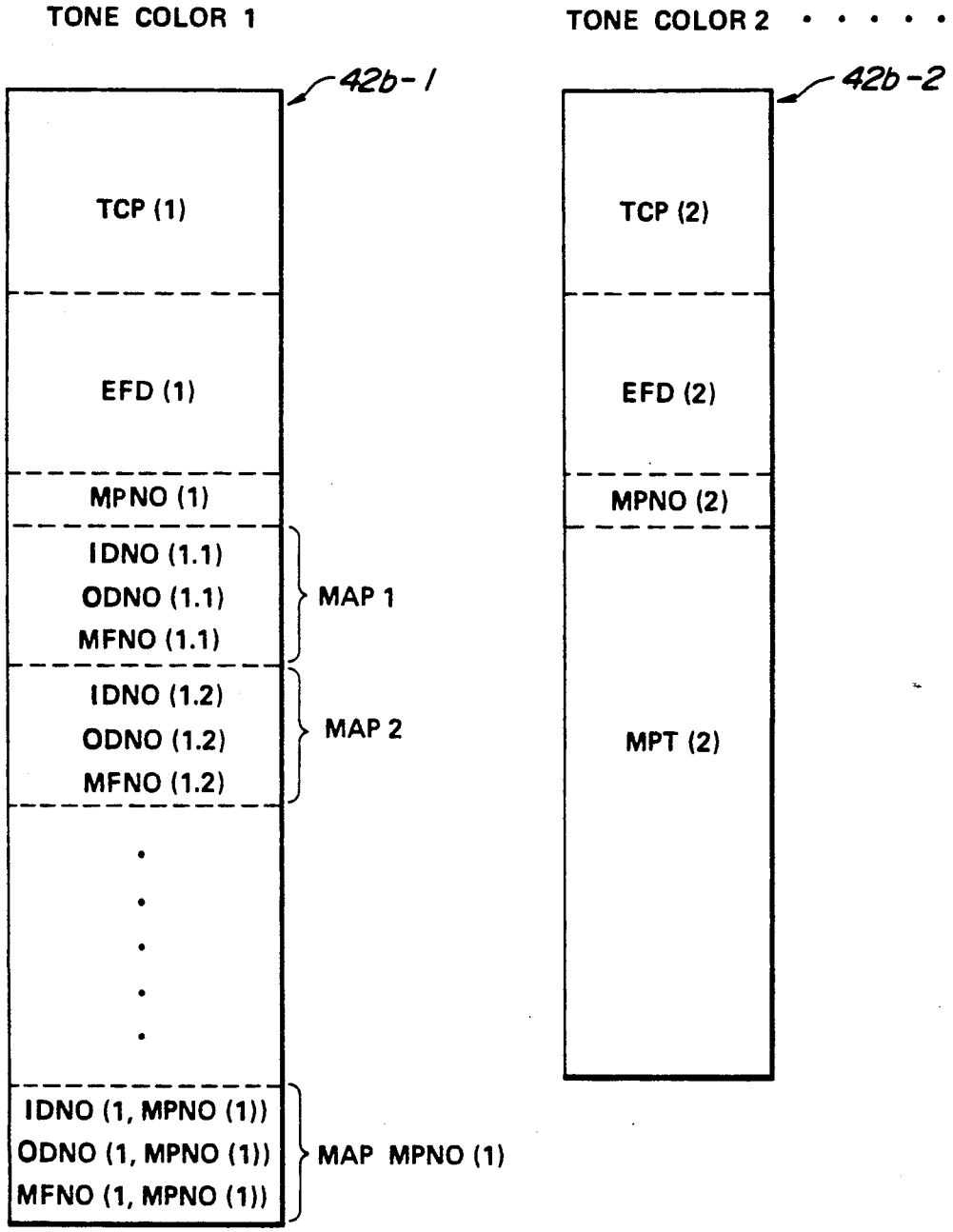
FIGS. 4 and 5 are the memory map in ROM shown in FIG. 1.
Figure 5:
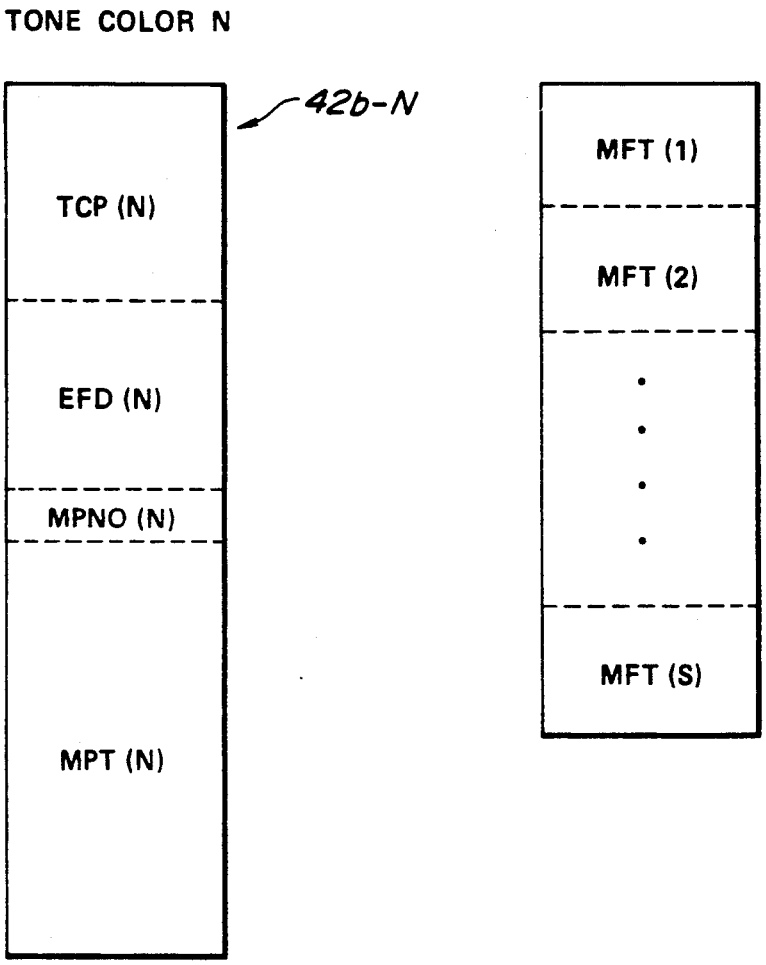

1. Name of operator
2. Name of timbre
3. Timbre 1
4. Timbre 2
5. Timbre N
6. Timbre N+1 (set by player)
7. Vibrato operator
8. Tremolo operator
9. Brilliance operator
10. Rate of vibrato, Depth of vibrato, Filter coefficient
11. Rate of amplitude modulation, Depth of amplitude modulation
12. Filter coefficient
13. Rate of vibrato, Depth of vibrato
14. Mixing ratio
15. Depth of vibrato
16. Depth of amplitude modulation, Depth of delay time modulation
17. Depth of vibrato, Filter coefficient
18. Rate of vibrato, Depth of vibrato, Rate of delay time modulation, Depth of delay time modulation
19. Rate of delay time modulation, Depth of delay time modulation Also mounted on the operation panel 20A are an effect map setting device 25 for setting the effect map and a timbre parameter setting device 26 for setting timbre parameters. The effect map setting device 25 comprises, as shown in FIG. 3, an indicator 25*a* for indicating the setting state of the effect map, a set operator 25*b* for setting the data of the effect map, a clear operator 25*c* for clearing the data of the effect map, a group of input device selecting operators 25*d* for designating input device numbers in data within the effect map (correspond to vibrato operator 21*a*, tremolo operator 21*b* and brilliance operator 21*c*), a group of output device selecting operators 25*e* for designating the kind of effects to be given to musical sound g: .erated in data within the effect map, and a group of table selecting operators 25*f* for selecting the mapping function tables which designate the data conversion characteristics in data within the effect map. The timbre parameter setting device 26 has a configuration similar to that of the effect map setting device 25, comprising indicators, set operators, clear operators, and a group of data value setting operators, and can set timbre parameters for arbitrary timbres.

Operation of the group of panel operators 20 is detected by an operator switch circuit 20*a* comprising plural operator switches corresponding to each operator. An indication control circuit 20*b* controls the lamps built in each operator of the group of timbre selecting operators 22, the indicators 25*a* in the effect map setting device 25, and the indicators within the timbre parameter setting device 26. The operator switch circuit 20*a* is connected to bus 50, and the operator detection signal detected by each operator switch is supplied to the microcomputer assembly 40 through bus 50. The indication control circuit 20*b* is also connected to bus 50 and controls the lamps and indicators 25*a* in response to the control data from the microcomputer assembly 40.

The musical sound signal generator assembly 30 is connected to bus 50 and has a musical sound signal forming circuit 31 which forms and outputs the musical sound signal having the pitch designated by keyboard 10 as well as the timbre and effect designated by the group of panel operators 20. Connected to this musical sound signal forming circuit 31 are a vibrato signal generator 32, a timbre register 33, a tremolo signal generator 34, and a mixing ratio register 35. The vibrato signal generator 32 has rate register 32*a* and depth register 32*b* and outputs the vibrato modulation signal, which has the frequency and amplitude corresponding to the parameters supplied from microcomputer 40 and stored in registers 32*a* and 32*b*, to the musical sound signal forming circuit 31. The timbre register 33 stores the parameters, which are supplied from the microcomputer assembly 40 and control the timbres, and outputs the stored parameters to the musical sound signal forming circuit 31. A tremolo signal generator 34 has a rate register 34*a* and a depth register 34*b* and outputs the tremolo modulation signal, which has the frequency and amplitude corresponding to the parameters supplied from microcomputer assembly 40 and stored in registers 34*a* and 34*b*, to the musical sound signal forming circuit 31. The mixing ratio register 35 stores the parameters, which are supplied from the microcomputer assembly 40 and controls the mixing ratio of the musical sound signal of multiple series, and outputs the stored parameters to the musical sound signal forming circuit 31.

The output of the musical sound signal forming circuit 31 is connected to a digital filter 36 and a delay time modulation circuit 37. The digital filter 36 controls and outputs the frequency characteristics, for example, brightness, of digital musical sound signal from the musical sound signal forming circuit 31. The delay time modulation circuit 37 gives the delay time modulation to the digital musical sound signal and outputs the signal. Also, the digital filter 36 is connected to the filter coefficient register 38 which stores the filter coefficient parameters supplied from the microcomputer assembly 40 and outputs the stored parameters to the digital filter 36. The delay time modulation circuit 37 is connected to a delay time modulation signal generator 39 which has a rate register 39*a* and depth register 39*b* and outputs the delay time modulation signal having the frequency and amplitude corresponding to the parameters supplied from the microcomputer assembly 40 and stored in registers 39*a* to the delay time modulation circuit 37.

Output from the delay time modulation circuit 37 is connected to a D/A converter 60 which converts the digital musical sound signal from modulation circuit 37 into an analog signal and outputs it to a sound system 70. The sound system 70 comprises amplifiers and speakers and generates a musical sound corresponding to analog signal.

The microcomputer assembly 40 comprises CPU 41, ROM 42 and RAM 43. The CPU 41 executes a program described later and controls the generation of musical sound signals at the musical sound signal generator assembly 30 in response to the operation of the keyboard 10 and the group of panel operators 20.

Figure 6A:
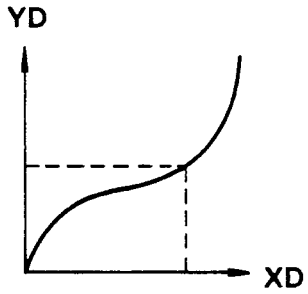
FIGS. 6A and 6B are data convention characteristics graphs.
Figure 6B:
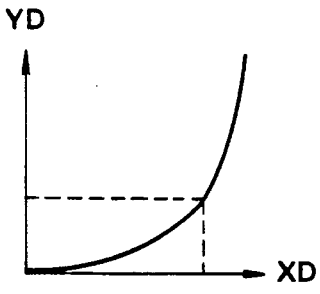

ROM 42 is divided into a program storage area 42*a* and a data storage area 42*b*. The program storage area 42*a* stores programs corresponding to the flowcharts shown in FIG. 9 to FIG. 14. The data storage area 42*b* comprises N (the number of tables) timbre tables 42*b*-1, 42*b*-2 . . . 42*b*-N, and S (the number of groups) mapping function table groups MFT (1), MFT (2) . . . MFT (S). The timbre tables 42*b*-n (N: integers of 1 to N) store plural timbre parameters TCP(n) for determining the basic timbers of generated musical sound, plural effect control data EFD(n) for designating the preset effect to be given to the musical sound in response to timbre selection, map number data MPNO(n) expressing the number of maps related to the musical sound, and the map data, the number of which is equal to MPNO(n) expressed by the map number data MPNO(n). As shown in Table 1, each map data comprises input device number data IDNO expressing the input device number (corresponds to vibrato operators 21*a*, tremolo operators 21*b*, and brilliance operators 21*c*), output device number data ODNO expressing the effect and kind (rate of vibrato, depth of vibrato, etc.), and mapping function table number data MFNO designating one of the mapping function table groups MFT(1), MFT(2) . . . MFT(S) which will be explained later. In this case, the number of the map number data MPNO(n) varies depending on the timbre, so that the number of map data varies by timbre tables 42*b*-1, 42*b*-2, . . . 42*b*-N. As shown in FIG. 6A and FIG. 6B, the mapping function table groups MFT(1), MFT(2), . . . MFT(S) store, in the form of a table or functional equation (such as $YD=XD^2$), the control data (control programs) for determining the characteristics of conversion from each operating position XD of vibrato operators 21*a*, tremolo operators 21*b* and brilliance operators 21*c* respectively to the output parameter YD.

Figure 7:
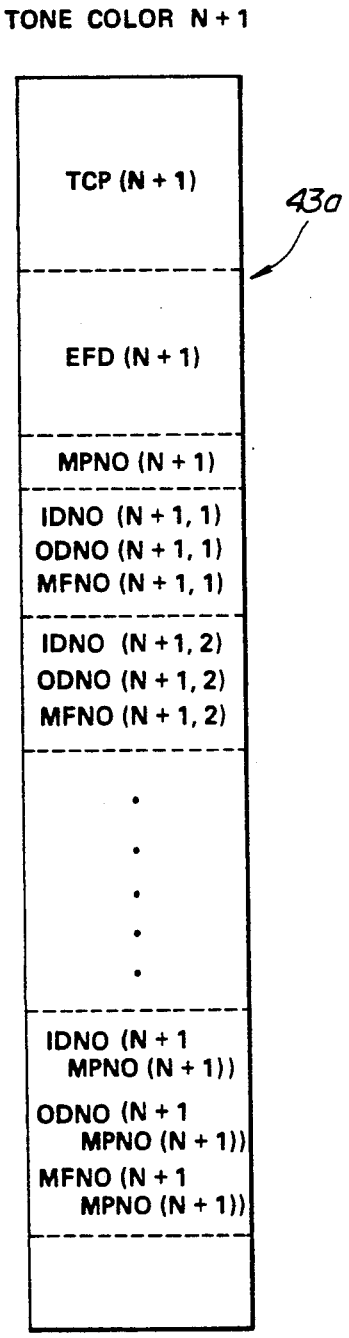
FIGS. 7 and 8 are the memory map in RAM shown in FIG. 1.
Figure 8:
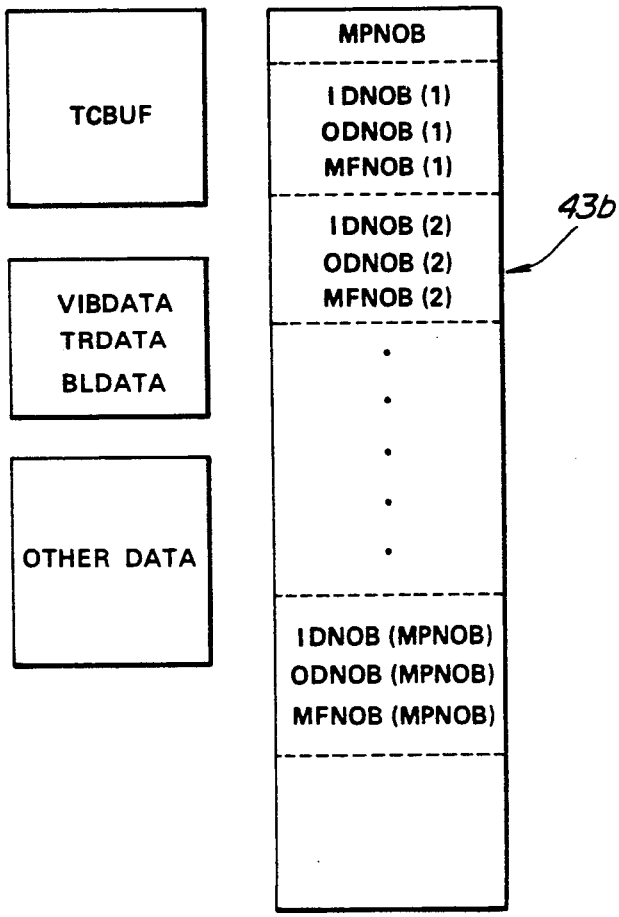

RAM 43 is divided into a data storage area 43*a* and working area 43*b*. As shown in FIG. 7, the data storage 43*a* comprises timbre tables N+1 corresponding to (N+1)th timbre. As in the case of timbre tables 42*b*-1, 42*b*-2,. . . 42*b*-N, the timbre table N+1 stores the map data comprising the timbre parameter TCP (N+1), effect control data EFD(n), map number data MPNO (N+1), input device number data IDNO, output device number data ODNO, and mapping function table number data MFNO, and the number of map data stored there is equal to MPNO(N+1). These various map data can be changed by the effect map setting device 25 and timbre parameter setting device 26. As shown in FIG. 8, temporarily stored in the working area 43*b*, in the form of various buffer data TCBUF, MPNOB, IDNOB(1), ODNOB(1), MFNOB(1) . . . IDNOB(MPNOB), ODNOB(MPNOB) and MFNOB(MPNOB), are the timbre parameter TCP stored in the timbre table selected out of said timbre tables 42*b*-1, 43*b*-2, . . . 42*b*-N and N+1, the number of which is N+1, the map number data MPNO, and MPNO-number of various map data comprising the input device number data IDNO, output device number data ODNO and mapping function table number data MFNO. Also, stored temporarily in the working area 43*b* are the data expressing the operating position of vibrato operations 21*a*, tremolo operators 21*b*, and brilliance operators 21*a* in the form of vibrato data VIBDATA, tremolo data TRDATA, and brilliance data BLDATA, respectively. Moreover, the working area 43*b* can store other data required for the execution of the program.

In the following, the operation of the preferred embodiment having the configuration as described above will be explained by referring to the flowcharts, FIG. 9 to FIG. 14.

Figure 9:
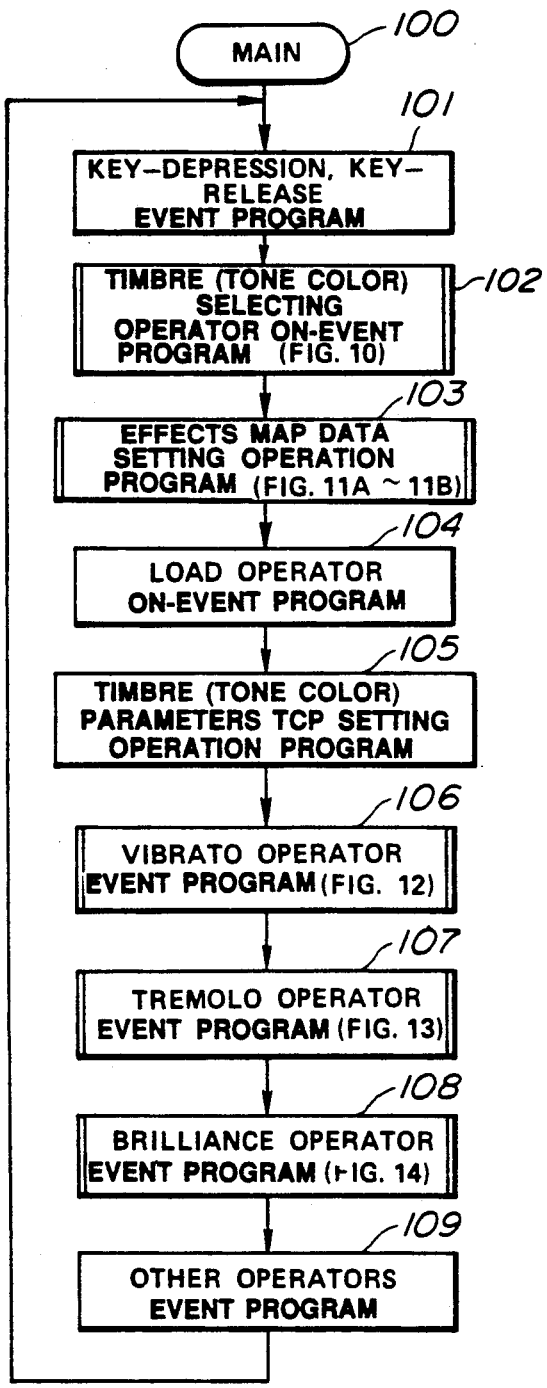
FIGS. 9 to 14 are the flowcharts corresponding to an example of program to be executed to by the microcomputer shown in FIG. 1.

When the power switch (not indicated) is turned on, the CPU 41 starts the execution of "main program" at step 100 in FIG. 9 and continues to execute the cyclic processing from step 101 to step 109, by which the generation of musical sound is controlled in response to the press and release of keys on keyboard 10 and the operation of the group of panel operators 20. Each of operations corresponding to the operation of keyboard 10 and the group of panel operators 20 will be described below.

Generation of musical sound

If any key on the keyboard 10 is pressed or released, then the CPU 41 detects the key pressed or released in cooperation with the key switch circuit 10*a* at step 101 and supplies the key information concerning the key pressed or released to the musical sound signal forming circuit 31 of the musical sound signal generator assembly 30 through bus 50. If the key information is related to a pressed key, then the musical sound signal forming circuit 31 begins to form a digital musical sound signal having the key pitch frequency corresponding to the pressed key and supplies the signal to D/A converter 60 through digital filter 36 and delay time modulation circuit 37. The D/A converter 60 converts the digital musical sound signal into an analog signal and supplies it to sound system 70. The sound system 70 then generates a musical sound corresponding to the digital musical sound signal. On the other hand, if said key information supplied is related to a released key, then the musical sound signal forming circuit 31 gradually attenuates, and then stops the digital musical sound signal related to the released key. Accordingly, the generation of musical sound related to the released key is stopped.

Selection of timbre

Figure 10:
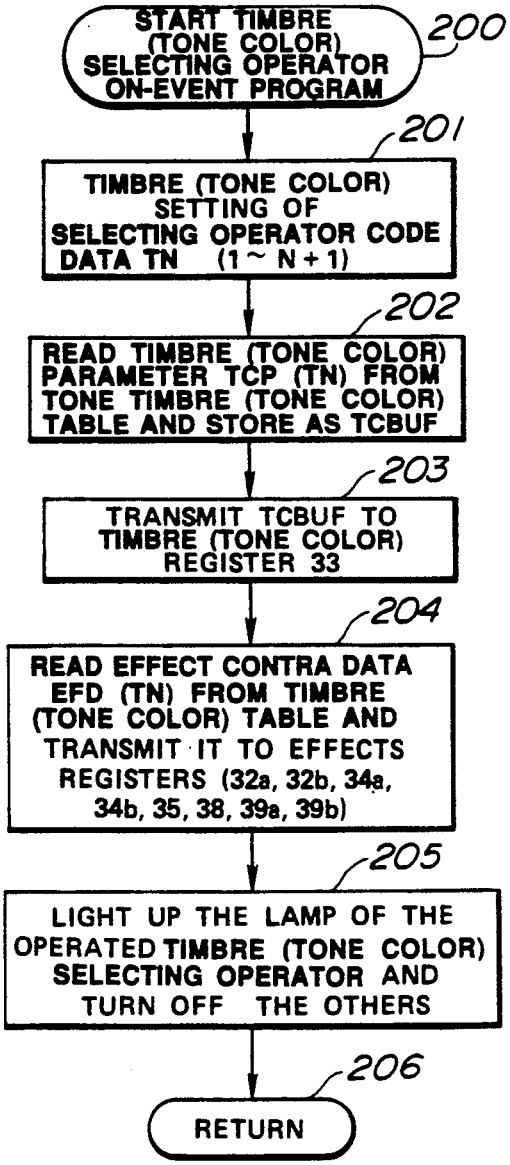

If any operator in the group of timbre selecting operators 22 is pressed, then the CPU 41 detects the pressing operation at step 102, starts the execution of "timbre selecting operator on-event program" shown in FIG. 10 at step 200, and sets the timbre selecting operator code data TN to a value expressing the timbre selecting operator pressed at step 201.

Then, the CPU 41, at step 202, reads a timbre parameter TCP (TN) from the timbre tables 42*b*-1, 42*b*-2, . . . 42*b*-N, and N+1 designated by the timbre selecting operator code data TN, stores it as timbre parameter buffer data TCBUF in the working area 43*b*, transfers at step 203 said stored timbre parameter buffer data TCBUF to the timbre register 33 of the musical sound signal generator assembly 30 through bus 50, reads at step 204 an effect control data EFD (TN) from the timbre table designated, and transfers it directly to registers 32*a*, 32*b*, 34*a*, 34*b*, 35, 38, 39*a* and 39*b* for various effects in the musical sound signal generator assembly 30 through bus 50. Then, various parameters corresponding to the timbres selected in the group of timbre selecting operators 22 are stored in various registers inside the musical sound signal generator assembly 30. Therefore, the musical sound generated in response to the key pressed or released at keyboard 10 will have the timbre selected by the player, and at the same time, the effects corresponding to the timbre selected are given to the musical sound. The effects, in this case, function as preset effects suited to the timbre and will be changed when vibrato operator 21*a*, tremolo operator 21*b*, or brilliance operator 21*c* is operated, as explained later.

After the processing at the step 204, the CPU 41 at step 205 turns on a lamp built in the operated timbre selecting operator and turns off other lamps in cooperation with the indication control circuit 20*b*. Through these events, the timbre selected is indicated by the lamp. The "timbre selecting operator on-event program" is terminated after processing at step 206, and control is then returned to "main program" (FIG. 9).

Setting operation for map data in the data storage area 43*a* corresponding to timbre table N+1 by the effect map setting device 25 will be described hereafter. This operation will be described based on the player's operating sequence. When the player first presses the clear operator 25*c*, the CPU 41 detects the on-event of clear operator 25*c* at step 103 (FIG. 9), starts the execution of "clear operator on-event program" at step 300 shown in FIG. 11A, clears all map data in timbre table N+1 at step 301, sets variable L to "1" at step 302, and terminates the execution of "clear operator on-event program" at step 303. Then, when the player presses one of the grouped input device selecting operators 25*d* in order to specify the input device number in map data (corresponds to vibrato operator 21*a*, tremolo operator 21*b* and brilliance operator 21*c*), the CPU 41 detects the on-event of one of the grouped input device selecting operators 25*d* at step 103 (FIG. 9), starts the execution of "input device selecting operator on-event program" at step 310 shown in FIG. 11B, sets input device number data ID to an operator code expressing the operator operated at step 311, indicates at step 312 the name of the input device (for example, "vibrato" as shown in FIG. 2) corresponding to said operator operated by means of indicator 25*a* in cooperation with indication control circuit 20*b*, and terminates the execution of "input device selecting operator on-event program" at step 313. Also, when the player presses one of the grouped output device selecting operators 25*e* in order to specify the output device numbers in the map data (correspond to the depth of vibrato, rate of vibrato, and brightness of musical sound), the CPU 41 detects the on-event of one of the grouped output device selecting operators 25*e* at step 103 (FIG. 9), starts the execution of "output device selecting operator on-event program" at step 320 in FIG. 11C, sets at step 321 the output device number data OD to the operator code expressing the operator operated, indicates at step 322 the output device name (such as "rate of vibrato" shown in FIG. 2) corresponding to said operator operate by means of the indicator 25*a* in cooperation with indication control circuit 20*b*, and terminates the execution of "output device selecting operator on-event program" at step 323.

Figure 11A:
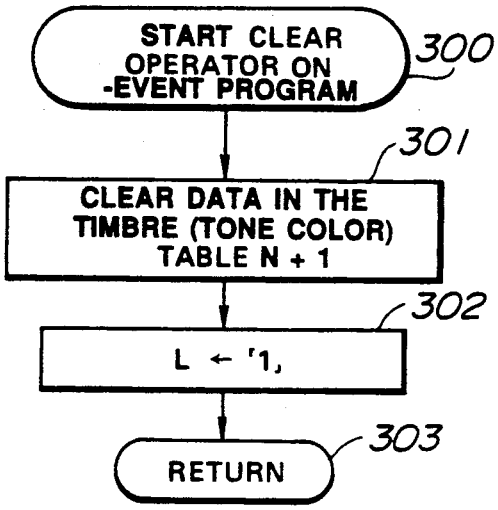
Figure 11C:
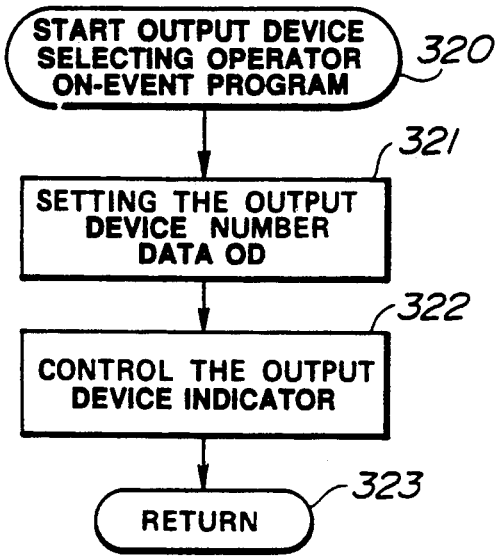
Figure 11B:
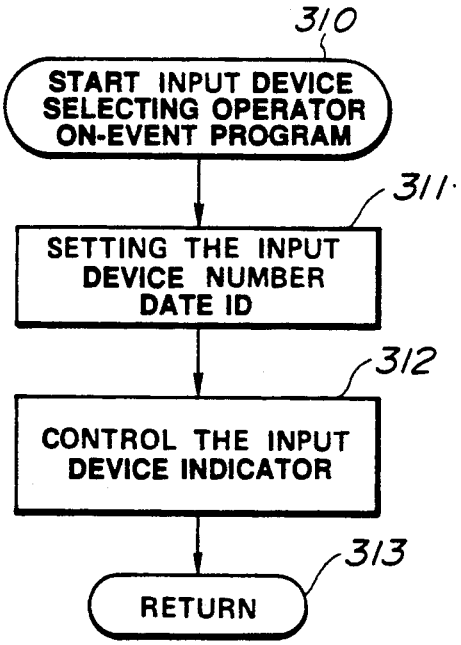
Figure 11D:
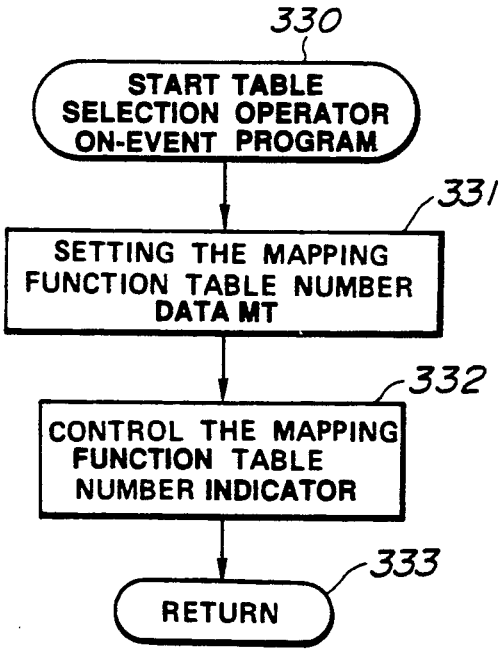

Also, when the player presses one of the grouped table selecting operators 25*f* in order to specify the mapping function tables MFT(1) to MFT(S) in the map data, the CPU 411 detects the on-event of one of the grouped table selecting operators 25*f* at step 103 (FIG. 9), starts the execution of "table selecting operator on-event program" at step 330 shown in FIG. 11D, sets at step 331 the mapping function table number data MT to the operator code expressing the operator operated, indicates at step 332 the mapping function table number (such as "2" as shown in FIG. 3) corresponding to the operator operated by means of the indicator 25*a* in cooperation with the indication control circuit 20*b*, and terminates the execution of "table selecting operator on-event program" at step 333.

Figure 11E:
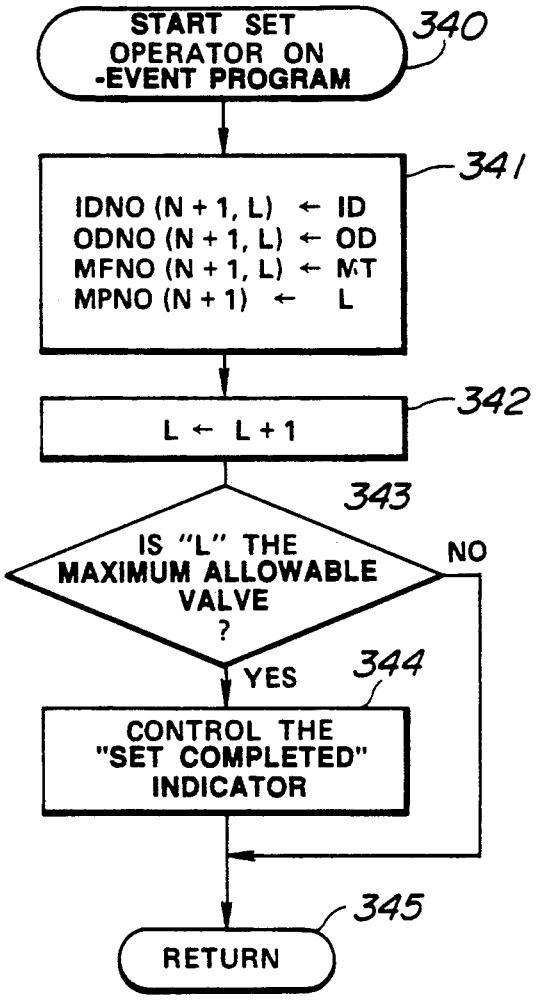
Figure 12:
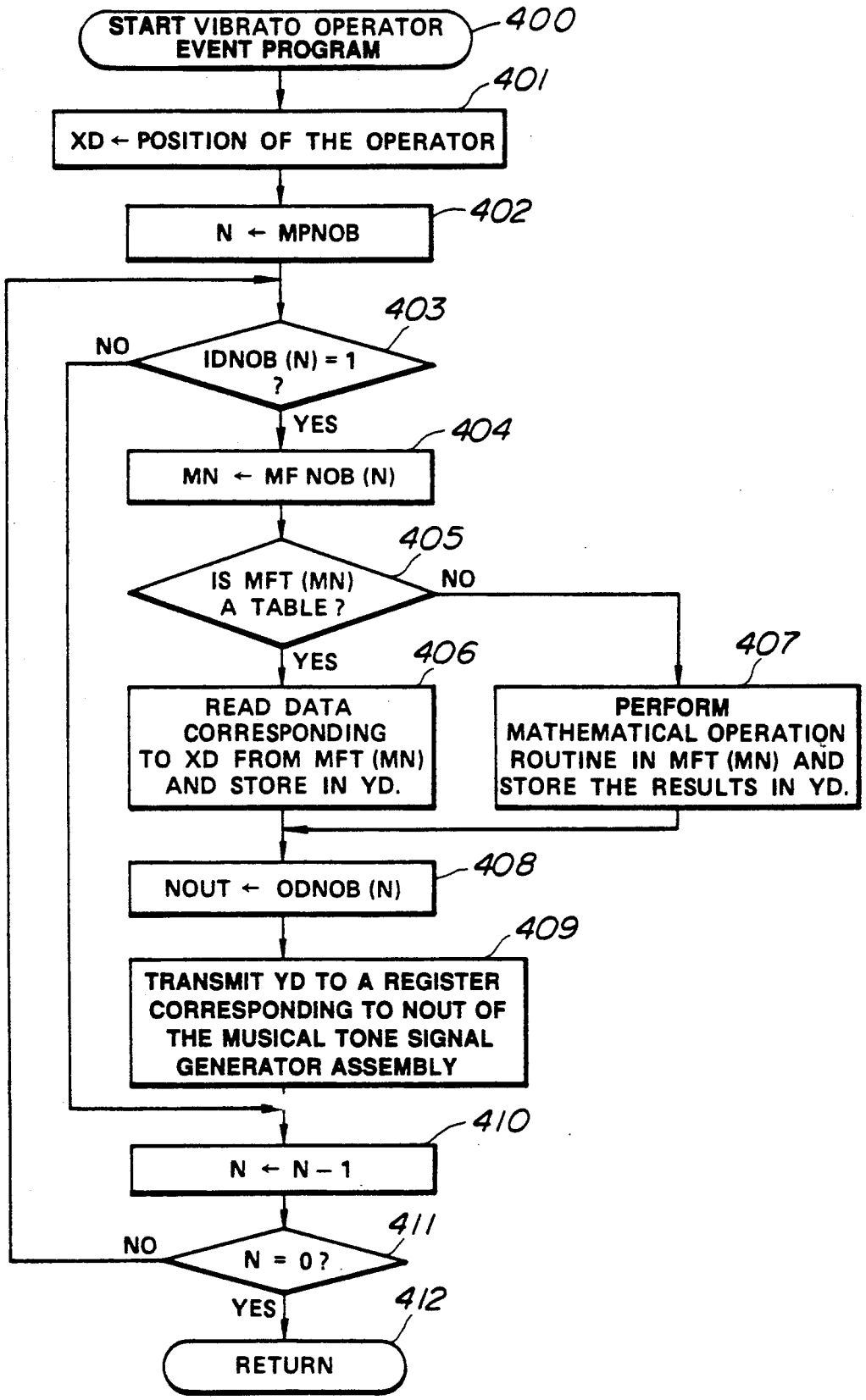

When the player presses the set operator 25*b* after inputting the input device number data ID, output device number data OD and mapping function table number data MT, the CPU 41 detects the on-event of the operator 25*b* at step 103 (FIG. 9), starts the execution of "set operator on-event program" at step 340 shown in FIG. 11E, sets at step 341 the input device number data INDO (N+1, 1), output device number data ODNO (N+1, 1), and mapping function table number data MFNO (N+1, 1) corresponding to the variable L (=1) in the data storage area 43*a* corresponding to timbre table N+1 to the input data ID, OD and MT, sets map number data MPNO (N+1) to variable data L, adds "1" to variable L (=1) at step 342, and judges whether the variable L has reached the allowable maximum value at step 343. When the variable L has not reached the allowable maximum value, the CPU 41 judges "NO" and terminates the execution of "set operator on-event program" at step 345.

In this state, the player repeatedly performs a series of operations described above for the grouped input device selecting operators 25*d*, grouped output device selecting operators 25*e*, grouped table selecting operators 25*f*, and set operators 25*b*. By doing so, input setting is made for the input device number data INDO (N+1, L), output device number data ONDO (N+1, L), and mapping function table number data MFNO (N+1, L) in response to the increase in variable L, and the map number data MPNO (N+1) is sequentially updated. Consequently, when the variable L has reached the allowable maximum value, the CPU 41 judges "YES" at step 343, indicates "set completed" by means of indicator 25*a* in cooperation with indication control circuit 20*b* at step 344, and terminates the execution of "set operator on-event program" at step 345. Then, input setting for map data in timbre table N+1 can be made to the allowable maximum amount depending on the player's taste.

On the other hand, if the series of operations described above for the grouped input device selecting operators 25*d*, grouped output device selecting operators 25*e*, grouped table selecting operators 25*f*, and set operators 25*b* are stopped before the variable L reaches the allowable maximum value, then the map data, the number of which is expressed by variable L at that time, are input and set in timbre table N+1.

Changing map data related to fixed timbre

Changing and setting of the map data related to fixed timbre corresponding to timbre tables 42*b*-1, 42*b*-2, . . . 42*b*-N will be described below with respect to the operation of load operator 24. In this case, if the player operates one of the grouped timbre selecting operators 22, then a timbre parameter corresponding to the operated timbre selecting operator is stored as timbre parameter buffer data TCBUF in the working area 43*b*, is transferred to the musical sound signal forming circuit 31, and the map data in timbre table N+1 is arbitrarily set by using the effect map setting device 25 as stated previously. When the player presses the load operator 24, the pressing of load operator 24 is detected at step 104 (FIG. 9), and the CPU 41 at the same step 104 stores all the map data of timbre table N+1 including MPNO (N+1), IDNO (N+1, n), ODNO (N+1, n)[where, n is an integer of 1 to MPNO (N+1)] in the working area 43*b* as map buffer data. By doing so, the map data can be indirectly set even for the fixed timbre, so that the map data arbitrarily set during the operation of the vibrato operator 21*a*, tremolo operator 21*b*, and brilliance operator 21*c* explained later can be utilized even for the fixed timbre.

Setting timbre parameters

Setting of timbre parameter TCP (N+1) located in the data storage area 43*a* corresponding to timbre table N+1 will be described below. This kind of setting can be made by a well known method and is not directly related to this invention. Therefore, it will be explained briefly. When the player operates various operators within the timbre parameter setting device 26, the CPU 41 sets the timbre parameter TCP (N+1) at step 105 (FIG. 9) in a manner similar to that for the effect map setting operation described above. When this timbre parameter setting is combined with the effect map setting, any desired effect can be given to a given timbre.

Effect control by vibrato operator 21*a*

When the vibrato operator 21*a* is operated, its operation is detected at step 106 (FIG. 9). The CPU 41 starts at step 400 the execution of "vibrato operator event program" shown in FIG. 12, inputs at step 401 the data expressing the position of operator 21*a*, stores the data in the working area 43*b* as operator position data XD, sets at step 402 the variable N to the map number buffer data MPNOB stored in the working area 43*b*, and judges at step 403 whether the input device number buffer data IDNOB (N) in the working area 43*b* corresponding to the variable N is "1" or not, that is, it is checked whether data IDNOB (N) has designated the vibrato operator 21*a* as the input device. In this case, if the input device number buffer data IDNOB (N) is not "1" and the vibrato operator 21*a* is not designated as the input device, then "NO" judgement is made. Then, cyclic processing comprising steps 403, 410 and 411 is executed, subtracting "1" from variable N by the processing of steps 410 and 411 until the variable N becomes "0".

If the input device number buffer data IDNOB (N) is "1" and vibrato operator 21*a* has been designated as input device, then "YES" judgement is made at step 403, the program advances to step 404 at which the mapping function table number data MN is set to the N-th mapping function table number buffer data MFNOB (N), and then in step 405, it is judged whether the mapping function table MFT (M ) in the data storage area 42 designated by the setting data MN has stored the conversion control data in the form of a table or functional equation. When the conversion control data are stored in the form of a table, the CPU 41 judges "YES" at step 405 and stores at step 406 the data (refer to FIG. 6A and FIG. 6B) which correspond to the operator position data XD set and stored from the designated mapping function table MFT (MN) by the processing at step 401 in the working area 43*b* as output parameter YD. When the conversion control data is stored in the form of a functional equation, the CPU 41 judges "NO" at step 405, executes at step 407 the function operation (arithmetical routine) using the operator position data XD as a variable in accordance with the functional equation (program) stored in the designated mapping function table MFT (MN), and stores the results of the operation as output parameter YD in the working area 43*b*.

After processing at steps 406 and 407, the CPU 41 sets at step 408 the output device number buffer data IDNOB (N) as output device number data NOUT in the working area 43*b* corresponding to the variable N and transfers, at step 409, the stored output parameter YD through bus 50 to the registers 32*a*, 32*b*, 34*a*, 34*b*, 35, 38, 39*a*, and 39*b* corresponding to the output device number data NOUT in the musical sound signal generator assembly 30. This permits control of the effect of musical sound generated in response to output parameter YD.

After processing at step 409, the program advances to step 410, then the processing at steps 403 to 411 is executed. Consequently, in response to the operation of vibrato operator 21*a*, one or plural effects using operator 21*a* as the input device can be controlled according to the different characteristics which are determined depending on the operating position of operator 21*a*, and also by the mapping function table MFT (MN). During the cyclic processing comprising steps 403 to 411, if the variable N becomes "0", that is, if all map data are referred to, then the CPU 41 judges "YES" at step 411 and terminates the execution of "vibrato operator event program" at step 412.

When the vibrato operator 21*a* is operated as described above, one or plural kinds of effects set arbitrarily by the player or in response to the timbre selected based on map data are given to the musical sound depending on the operation, and the degree of effects is controlled by the operating position of vibrato operator 21*a*, which has been changed depending on the timbre selected or by the characteristics arbitrarily set by the player.

Effect control by tremolo operator 21*b*

Figure 13:
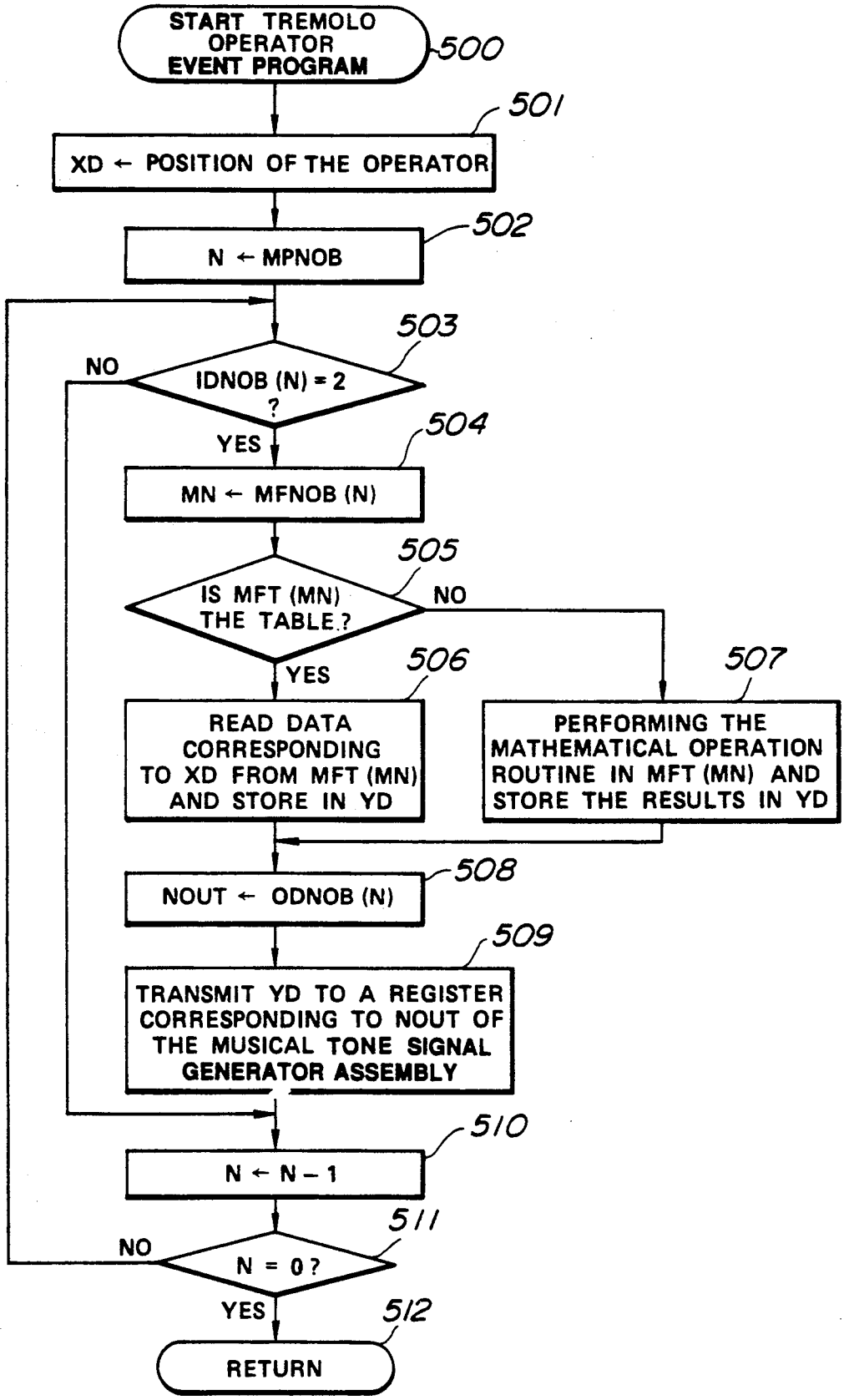

When tremolo operator 21*b* is operated, the operation is detected at step 107 (FIG. 9), and the CPU 41 executes "tremolo operator event program" shown in FIG. 13. In this case, the input device number expressing the tremolo operator 21*b* is "2" and therefore it is judged whether the input device number buffer data IDNOB (N) in working area 43*b* is "2" or not at the step 503 in "tremolo operator event program". But other processing is the same as the case of the "vibrato operator event program", so that the description of the other processing is omitted here by giving code numbers starting from 500 to the steps shown in FIG. 13 which corresponds to the code numbers shown in FIG. 12.

Because of the above, when the tremolo operator 21*b* is operated, the same operation as the case of the vibrato operator 21*a* results. That is, one or plural kinds of effects set arbitrarily by the player or corresponding to the timbre selected based on map data are given to musical sound depending on the operation of the tremolo operator 21*b*, and the degree of the effects is controlled to the value of the operating position of tremolo operator 21*b*, which has been changed depending on the timbre selected or by the characteristics arbitrarily set by the player.

Effect control by brilliance operator 21*c*

Figure 14:
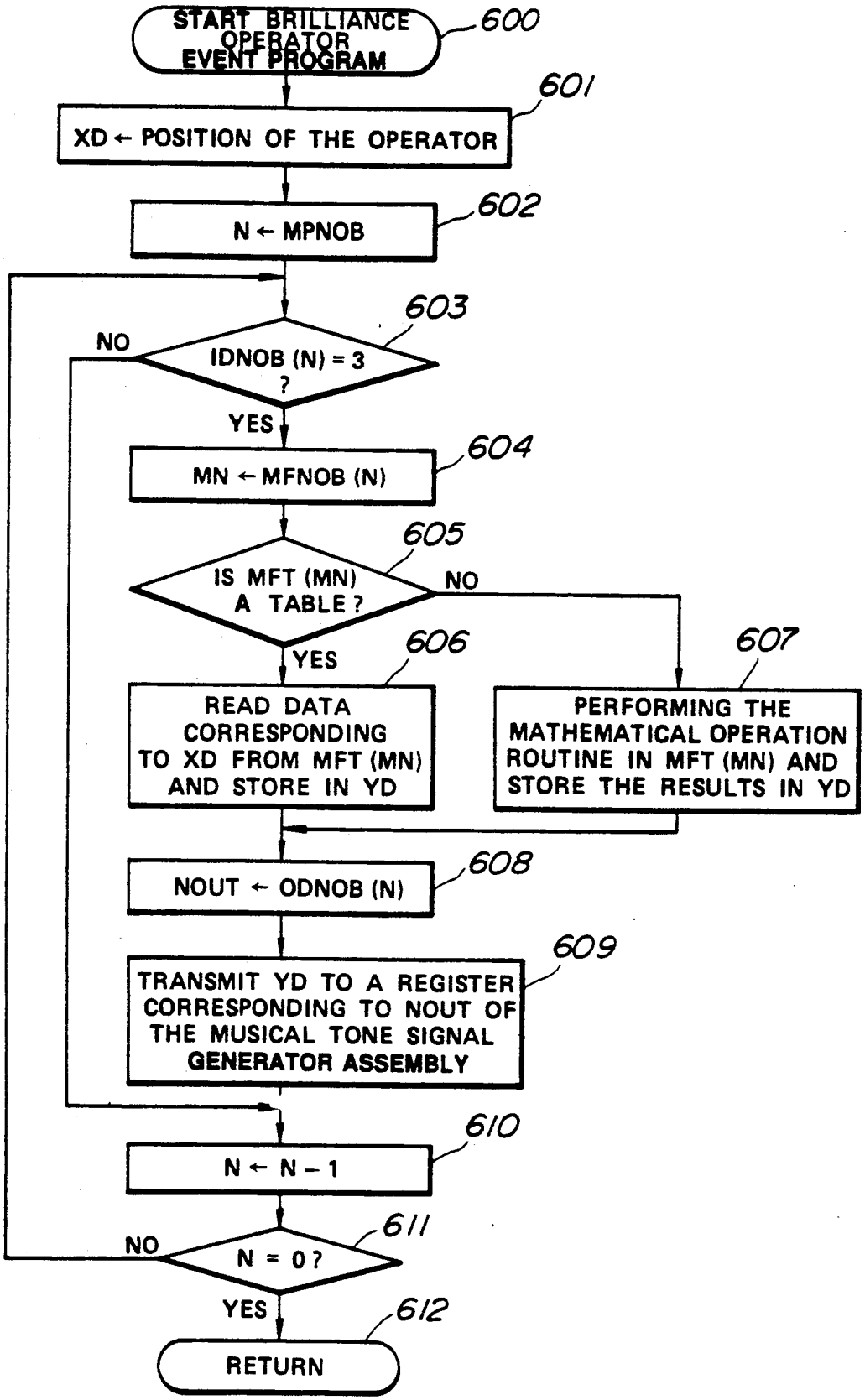

When the brilliance operator 21*c* is operated, this operation is detected at step 108 (FIG. 9), and the CPU 41 executes "brilliance operator event program" shown in FIG. 14. In this case, the input device number expressing the brilliance operator 21*c* is "3" and thus it is judged whether the input device number buffer data IDNOB (N) in the working area 43*b* is "3" or not at the step 603 of "brilliance operator event program". But other processing is the same as the case of "vibrato operator event program", so that the description of the other processing is omitted here by giving code numbers starting from 600 to the steps shown in FIG. 14 which corresponds to the code numbers shown in FIG. 12.

Because of the above, when the brilliance operator 21*c* is operated, the same operation as the case of vibrato operator 21*a* results. That is, one or plural kinds of effects set arbitrarily by the player or corresponding to the timbre selected based on map data are given to musical sound depending on the operation of the brilliance operator 21*c*, and the degree of the effects is controlled to the value of operating position of the operator 21*c*, which has been changed depending on the timbre selected or by the characteristics arbitrarily set by the player.

Other processing

When other grouped operators 23 related to sound volume and so forth are operated, the operation is detected at step 109 (FIG. 9) and, at the same time, the control data related to the operation is supplied to the musical sound signal generator assembly 30 and the volume of musical sound generated is controlled in response to the control data.

Example of modifications

It should be noted that this invention is still effective even though the following modifications are given to the preferred embodiment:

(1) Though vibrato, tremolo, mixing ration, filter characteristics, delay time modulation, etc. are described as the effects to be given to musical sound in the preferred embodiment, it is possible to adopt also phase modulation effect, reverberation effect, etc. In this case, the depth and rate of phase modulation and the reverberation time and level of reverberation effect should be controlled in response to the timbre selected and the operation of the operator. Also, attack time, attack level, decay time, etc. related to the envelope of musical sound may be controlled and given as effects to musical sound.

(2) In the preferred embodiment, only one timbre table is adopted for arbitrarily setting timbre parameter and map data by the player, but plural timbre tables can be also provided.

(3) In the preferred embodiment, the giving of effect to musical sound is controlled by the effect control data EFD in the timbre table independent, from the operation of vibrato operator 21*a*, tremolo operator 21*b* and brilliance operator 21*c* during the operation of the group of timbre selecting operators 22. However, the giving of the effects to musical sound may be also controlled in response to the setting positions of the operators 21*a*, 21*b* and 21*c* as same as the case of operation of the operators 21*a*, 21*b* and 21*c* during the operation of the group of timbre selecting operators 22.

(4) In the preferred embodiment, data conversion is made depending on table or arithmetic expression when converting the operating positions XD of vibrato operator 21*a*, tremolo operator 21*b*, and brilliance operator 21*c* into the output parameter YD. However, the data conversion may be performed by combining the table with an arithmetic expression or by other methods.

(5) In the preferred embodiment, the contents of the mapping function table are predetermined and cannot be changed later, but it may be possible to make the contents arbitrarily variable by the player. Also, the mapping function table has been provide separately from the map data for each timbre and is designated by the mapping function table number data MFNO. However, data identical to the contents of the mapping function table may be stored together with input device number data INDO and output device number data ONDO in the map data within each timbre table.

(6) In the preferred embodiment, the vibrato operator 21*a*, tremolo operator 21*b* and brilliance operator 21*c* are made of rotary control type operators. However, vibrato operator 21*a*, tremolo operator 21*b*, and brilliance operator 21*c* may be made of operators having different shape or different input form such as sliding type controls or operators having plural switching elements corresponding to plural different input values.

(7) Though a microcomputer is adopted in the preferred embodiment of the invention, a hardware circuit made exclusively for this invention may be utilized instead.

What is claimed is:

1. An apparatus for generating musical sound control parameters for supplying said musical sound control parameters to a musical sound generating apparatus for the purpose of utilizing said musical sound control parameters for forming musical sound at said musical sound generating apparatus, the apparatus comprising:

(a) timbre selecting operators;

(b) timbre parameter generating means for supplying timbre parameters corresponding to timbre selected by said timbre selecting operators to said music sound generating apparatus; and (c) effect control parameter generating means for supplying plural effect control parameters representing which of various effects are to be imparted to the musical sound and the degree of each effect to be imparted to the musical sound, the parameters varying in response to timbre selected by said timbre selecting operators, whereby effects of different degree can be provided in response to selection of different timbres.

2. An apparatus for generating musical sound control parameters in accordance with claim 1 in which the effect control parameter generating means is capable of generating an effect control parameter unique for each timbre selected by the timbre selecting operator.

3. An apparatus for generating musical sound control parameters in accordance with claim 1 including effect control parameter kind selecting and setting means in which the effect control parameter generating means is capable of generating plural kinds of effect control parameters varying in response to the operating situation of said effect control parameter kind selecting and setting means.

4. An apparatus as in claim 1, further including plural effect control operators for controlling the degree of various effects, wherein the effect control parameter generating means operates such that the supplied effect control parameters vary in response to the operating state of the effect control operators in addition to the selected timbre.

5. An apparatus for generating musical sound control parameters in accordance with claim 4 in which the effect control parameter generating means is capable of generating an effect control parameter varying in response to the operating state of the effect control operators, wherein said varying response is unique for each timbre selected by the above mentioned timbre selecting operator.

6. An apparatus for generating musical sound control parameters in accordance with claim 4 including effect control parameter characteristics selecting and setting means in which the effect control parameter generating means is capable of generating plural effect control parameters, said plural effect control parameters of varying change characteristics varying in response to the operating situation of said effect control parameter characteristics selecting and setting means.

7. An apparatus for generating musical sound control parameters for supplying said musical sound control parameters to a musical sound generating apparatus for the purpose of utilizing said musical control parameters for generating musical sound at said musical sound generating apparatus, the apparatus for generating musical sound control parameters comprising:

(a) a musical tone color selector for selecting musical tone color from among plural tone colors:

(b) musical tone color parameter generating means for generating musical tone color parameters according to the selection of the musical tone color selector and providing the musical sound generating apparatus therewith; and (c) effect control parameter generating means for generating effect control parameters representing the degree of at least one effect to be imparted to a musical sound in response to the selection of the musical tone color selector, wherein a different degree of any particular effect can be provided in response to the selection of different tone colors.

8. An apparatus for generating musical sound control parameters according to claim 7 wherein the effect control parameters are different from one another according to the selection of the musical tone color selector.

9. An apparatus as in claim 7 further including an effect control operator, wherein the effect control parameter generating means generates effect control parameters in response to both the selection of musical tone color selector and the operation of the effect control operator.

10. An apparatus for generating musical sound control parameters according to claim 9 wherein the effect control parameters vary with time in different ways according to the selection of the musica¹ ɔne color and the operation of the effect control operator.

11. An apparatus for generating musical sound control parameters for supplying said musical sound control parameters to a musical sound generating apparatus for the purpose of utilizing said musical sound control parameters for generating musical sound at said musical sound generating apparatus, the apparatus for generating musical sound control parameters comprising:

(a) an effect control operator for controlling the degree of at least one effect;

(b) effect control parameter generating means for generating at least one effect control parameter representing the degree of an effect to be imparted to a musical sound in response to the operation state of said effect control operator and providing the musical tone generating apparatus therewith; and (c) parameter selecting means for selecting at least one effect control parameter to be imparted to said effect control operator.

12. An apparatus for generating musical sound control parameters for supplying said musical sound control parameters to a musical sound generating apparatus for purpose of utilizing said musical sound control parameters for generating musical sound at said musical sound generating apparatus, the apparatus for generating musical sound control parameters comprising:

(a) an effect control operator;

(b) effect control parameter generating means for generating effect control parameters representing the degree of at least one effect to be imparted to a musical sound, said parameters varying in response to the operating of the effect control operator and said generating means providing the parameters to the musical sound generating apparatus; and (c) variation characteristics selecting means for selecting a variation in response to the sate of the effect control operator to be provided by said effect control parameter generating means to said musical sound generating apparatus.

13. An apparatus for generating musical sound control parameters comprising:

(a) a plurality of operators for inputting numerical data, said data capable of being varied corresponding to an operating position of said operators;

(b) a plurality of tables having conversion control data, said conversion control data representing conversion characteristics from output data of said operator to a parameter to be generated;

(c) selecting means for selecting a table for each of said generators; and (d) a parameter generating means for generating a parameter corresponding to each operator according to at least an output of a corresponding selected table.

14. An apparatus for generating musical sound control parameters comprising:

(a) an operator for inputting numerical data, said data capable of being varied corresponding to an operating position of said operator;

(b) a plurality of tables having conversion data, said conversion data representing conversion characteristics from output data of said operator to parameters to be generated;

(c) selecting means for selecting at least one table from said plurality of tables; and (d) a plurality of parameter generating means for generating musical tone parameters, wherein said apparatus is capable of simultaneously generating a plurality of musical tone parameters by operating the operator.

15. An apparatus for generating musical sound control parameters comprising:

(a) a plurality of operators for inputting numerical data;

(b) a plurality of parameter generating means for generating musical sound control parameters;

(c) a specifying means for specifying correspondence of one of said operators with one of said parameter generating means; and (d) control means for linking one of said operators to one of said parameter generating means according to said correspondence so that said one of said parameters is generated in response to a predetermined one of said operators.

* * * * *